US007144416B2

(12) United States Patent
Struckmeier et al.

(10) Patent No.: US 7,144,416 B2
(45) **Date of Patent: *Dec. 5, 2006**

(54) SUCKING DEVICE

(75) Inventors: Hans Struckmeier, Pattensen (DE); Armin Struckmeier, Pattensen (DE); Rolf Hinz, Herne (DE); Rolf Brockhaus, Dortmund (DE)

(73) Assignee: Novatex GmbH, Pattensen (DE)

( * ) Notice: Subject to any disclaimer, the term of this patent is extended or adjusted under 35 U.S.C. 154(b) by 214 days.

This patent is subject to a terminal disclaimer.

(21) Appl. No.: 10/223,927

(22) Filed: Aug. 20, 2002

(65) Prior Publication Data

US 2003/0181947 A1 Sep. 25, 2003

(30) Foreign Application Priority Data

Mar. 22, 2002 (DE) ..... 102 12 847
Jun. 21, 2002 (DE) ..... 102 27 787

(51) Int. Cl.
*A61J 17/00* (2006.01)

(52) U.S. Cl. ..... 606/236

(58) Field of Classification Search ..... 606/234, 606/235, 236; 215/11.5; D24/194, 196
See application file for complete search history.

(56) References Cited

U.S. PATENT DOCUMENTS 3,424,157 A * 1/1969 Di Paolo ..... 215/11.4
3,924,621 A * 12/1975 Cassimally ..... 606/236
3,964,489 A * 6/1976 Kesselring ..... 606/236
4,078,570 A * 3/1978 Frodrich et al. ..... 606/236
RE30,526 E * 2/1981 Hurst et al. ..... 128/360
4,324,249 A * 4/1982 Sundkvist et al. ..... 606/236
4,381,785 A * 5/1983 Robbins ..... 606/236
4,403,613 A * 9/1983 Panicci ..... 606/236
4,493,324 A * 1/1985 Johnston ..... 606/236
4,796,628 A * 1/1989 Anderson ..... 606/236
5,004,473 A * 4/1991 Kalantar ..... 606/234
5,156,617 A * 10/1992 Reid ..... 606/234
5,275,619 A * 1/1994 Engebretson et al. ..... 606/236
5,391,184 A * 2/1995 Rosenthal ..... 606/236
5,578,058 A * 11/1996 Chen ..... 606/236
5,665,113 A * 9/1997 Decker et al. ..... 606/234
5,759,195 A * 6/1998 Fields et al. ..... 606/236
6,058,649 A * 5/2000 Bittman et al. ..... 606/234
D448,486 S * 9/2001 Horntrich ..... D24/194
6,325,817 B1 * 12/2001 Shen ..... 606/236
6,470,200 B1 * 10/2002 Walker et al. ..... 600/344

FOREIGN PATENT DOCUMENTS

DE 20022126 * 4/2001
GB 2192549 A * 1/1988

* cited by examiner

*Primary Examiner*—Michael Thaler
(74) *Attorney, Agent, or Firm*—Fay, Sharpe, Fagan, Minnich & McKee, LLP; Karl W. Hauber

(57) ABSTRACT

Described is a sucking device with a sucking body as well as a shaft, whereby the sucking body is equipped with a recess extending in longitudinal direction of the sucking device. Said sucking device is designed in such manner that the recess, seen in longitudinal section, terminates essentially flat toward the anterior free end of the sucking body. The recess preferably extends essentially over the entire length of the sucking body. In sectional view, the shaft preferably presents an angulated shape. From a jaw-orthopedic aspect, this sucking device proves itself as particularly beneficial, whereby it simultaneously stimulates the baby/small child to uniform sucking and/or serves for position of repose.

29 Claims, 2 Drawing Sheets

SUCKING DEVICE

The invention concerns a sucking device, in particular a pacifying sucking device for babies or small children.

Pacifiers for babies or small children are obtainable on the market in numerous different types of design and sizes. Such pacifiers generally present a sucking body, a connection piece or shaft as well as a lip shield or mouth plate, connected directly or indirectly with the shaft. In such an arrangement, the sucking body and the shaft generally consist of elastomers or rubber. The sucking body and the shaft usually include an interior hollow space, which is filled with air, as a consequence of which these components generally are very voluminous.

It has been determined that the use of pacifiers according to the state of the art can lead to malposed teeth as well as malformations of the jaw. If, however, no pacifiers are made available to the baby/small child, the result is frequently that the baby/small child will suck on its thumb, its finger or other objects, which generally causes even more serious defects in the positions of the teeth, in particular frontal open bite and lateral bite.

A sucking device is known from DE 200 22 126 U1 which comprises a mouth-insertable sucking component and a plate, which are produced as single piece. The sucking component has the shape of a spoon, with a bulge having been molded onto the side of the sucking component that is directed towards the mouth when in use.

SUMMARY OF THE INVENTION

One advantage of the present invention consists in specifying a sucking device, in particular a pacifying sucking device or a drinking- or bottle sucking device, which is of benefit from a mandibular/maxillary-orthopedic aspect, whereby it is intended to simultaneously stimulate the baby/small child to engage in uniform sucking and/or for position of repose.

According to one embodiment of the invention, said advantage is obtained by the inventive sucking device having a sucking body, a shaft or a connection piece, with the sucking body being equipped with a recess extending in longitudinal direction of the sucking device, with the recess, viewed in longitudinal section, ending flatly toward the anterior, free end of the sucking body.

If the sucking device is designed as pacifier, it also has a lip shield or mouth plate connected directly or indirectly with the shaft.

The anterior, free end of the sucking body is that end which, when viewed in longitudinal direction of the sucking device, is the farthest distance from the shaft. In other words, it is that end which will get first into the oral cavity, when being inserted into the mouth. Different from the state of the art according to DE 200 22 126 U1, the sucking body thus does not present the shape of a spoon, with the profound curvature of the recess in the anterior region, depicted in FIG. 2 of this specification. Instead, the longitudinal recess in the sucking body of the inventive sucking device is designed in the shape of a shovel, i.e. with greater indentation and/or a convex curvature in the posterior region, which ends flatly or only slightly curved toward the anterior end. Thus, no bulge is present in the anterior region of the sucking body. The tongue of the baby or the small child thus does not meet with any resistance, the tongue is not held back but is able to position itself in normal position direction, at the level behind the upper front teeth.

Based on the introduced deformation (recess), lower volume is achieved with respect to the sucking body, in particular smaller thickness than with traditional pacifiers, and this applies to both the hollow body version as well as the solid body version.

According to another embodiment of the invention, the advantage is obtained by the inventive sucking device, which may be designed as pacifier as well as nutritional or bottle sucking device, presents a sucking body and also a shaft, whereby the sucking body comprises an essentially flat underside, which essentially extends in parallel to the longitudial axis A of the sucking device. The sucking body of the inventive sucking device thus extends, at least with respect to its underside, in flat fashion, so that the tongue does not meet here any resistance either.

Since the sucking body essentially extends in the direction of the longitudinal axis of the sucking device, the sucking body, over its entire length, continuously rests against the upper side of the tongue.

According to a preferred specific embodiment, the ratio of maximum height h of the sucking body vis-a-vis its length amounts to no more than 0.7, preferably no more than 0.6 and particularly preferred no more than 0.5. "Height" in the context of this invention means the sum of those distances between the highest-positioned point of the sucking body and the lowest-positioned point of the sucking body relative to the longitudinal axis of the sucking device. In this context, the designation "top" and "bottom" refers to the position of the sucking device which said sucking device occupies when it is inserted into the mouth of the baby of small child. The sucking device designed according to the preferred embodiment thus presents a relatively flat sucking body in proportion to its longitudinal expansion. There is thus no excessively "bulgy" element in the mouth of the baby.

The inventive design of the sucking device further results in the benefit that the small child itself automatically inserts the sucking device in its correct position into the oral cavity. Should the baby insert the sucking device in inverted position into the oral cavity, i.e. with the recess showing in upward direction, the sucking body would—caused by the curvature of the shaft or the connection piece—press on the tongue in downward direction, which would immediately be perceived as unpleasant by the small child and the position of the sucking device would correspondingly be corrected.

The sucking body and the shaft of the inventive sucking device are designed in both hollow-body form as we as solid form, preferably as a single piece, i.e. they are made from the same material and change over from one to the other without connecting seam. The inventive construction of the pacifier makes it possible to design the sucking body as well as the shaft both with and without interior hollow space.

When inserting the sucking device into the oral cavity of the baby or the small child, the tongue automatically positions itself into the recess and presses the sucking body against the roof of the palate. Since, as a result, the air-filled hollow space can be given up, it is possible to manufacture sucking body and shaft of the inventive sucking device with lesser volume, in particular with smaller thickness than most of the sucking devices which are currently obtainable on the market.

According to another embodiment, sucking body and shaft can be made by two-component method, i.e. they are made of different materials and joined to each other.

The inventive design of these components is specifically recommendable because it is possible to prevent or reduce malpositions and/or jaw anomalies, such as the so-called "open bite in front".

The sucking body has, in fact, the effect of a foreign body, the same as, for example, the thumb inserted into the mouth between the rows of teeth of the upper and lower jaws. If such foreign bodies exert pressure on the teeth over extended periods of time, there may result changes in the positions of the teeth. Thus, continued pressure of 25 pounds per $cm^2$ of root surface is sufficient in order to move the front teeth. As a rule, they are protruded (moved forward) whereby the fulcrum lies in the upper third of the root. Specifically the upper front teeth can additionally be intruded (moved into the jaw). Depending upon the extent of the movement, the jaw bone can also be deformed. This results in the already earlier described open bite. Since the root surface of the baby teeth is smaller by far, lower continued pressure is consequently required in order to result in a positional movement of the teeth. Any application of pressure in the interior of the mouth, i.e. between the rows of teeth, should, therefore, be avoided to the extent possible According to a beneficial embodiment of the invention, the recess essentially extends over the entire length of the sucking body. This makes it possible that the tongue can move forward, alongside the sucking body, into its natural position, without meeting with any resistance, such as for example bulgings or protrusions. Due to the possibility of freer movement of the tongue, the pressure exerted upon teeth and jaw is further minimized.

The shaft, viewed in longitudinal section, preferably presents an angulated shape. The angulated shape can be either a sharp kink or a bend or curvature. In case of a pacifying sucking device, the shaft constitutes the connection between the lip shield and the sucking body. In case of a drinking sucking body, the shaft generally forms the connection between the sucking body and the body of the bottle of a hollow space of the sucking device which is positioned before the body of the bottle.

Starting from the lip shield, the shaft, in this embodiment, initially extends horizontally between the lips and the front row teeth of the upper and lower jaws, in order to then ascend with a kink or a bend behind the upper incisors, in sloping fashion upward in the direction of the palate. As a result, the sucking component lies higher (i.e. cranially) than an imagined horizontal between the exit point of the shaft from the lip shield and the sucking body. The term "higher" refers in this context to that particular position of the sucking device which it occupies if it is inserted in the correct position into the oral cavity of the baby or the small child. In such arrangement, the side of the sucking body presenting the recess is oriented toward the tongue.

Due to the angulated form of the shaft, the sucking body is conducted into the arched palate of the upper jaw and rests against the palate. Because of the angulated, significantly thinner shaft, it is possible for the upper and lower incisors to maximally approach each other, whereby they are impeded to a lesser extent than in case of a horizontally extending shaft.

The course of the angulated shaft follows the so-called sagital front teeth stage. This optimally prevents or at least reduces the development of an open sucking bite caused by excessive sucking at a pacifier with traditional shaft. Moreover, the sucking body automatically rests against the roof of the palate.

As already mentioned, it is of benefit if the sucking body, in particular the shaft, is designed with the smallest possible dimensions. In this context it has proven itself of advantage if the sucking body is designed in such fashion that it conically tapers to its anterior free end, when viewed from above or below. This permits convenient insertion of the sucking body into the oral cavity of the baby or the small child.

According to a preferred embodiment, the sucking body and the shaft have a combined length of approximately 15 to 32 mm, in particular approximately 15 to 30 mm and, particularly preferred, of approximately 24 to 28 mm. Tests have shown that up to the time when milk teeth appear, there is only an insignificant increase in the length and the width of that portion of the jaw relevant for sucking. Also, growing in width during subsequent months of life amounts to only a few millimeters, so that the stated ranges in length for the sucking component, i.e. for the sucking body plus shaft, are adequate for all ages of the baby and/or child during which a sucking device is used. The relatively small length of the sucking component rather corresponds to the mammilla of nursing women, the length of which generally ranges between 5 and 15 mm, on average 11 mm.

As already mentioned, the shape and size or thickness of the shaft is also of essential significance in preventing the development of malposed teeth. Viewed in cross-section, vertically to the longitudinal direction of the sucking device, the shaft generally has the shape of a rectangle with rounded edges or an elliptical cross-section. When the sucking device is introduced into the oral cavity, the shaft extends from the lip shield outside the mouth inwardly into the oral cavity, up to the sucking body which rests against the palate. The shaft thus extends between the upper and lower rows of front teeth, whereby these exert pressure upon the shaft with closed position of the mouth. Only slight mouth closing movements are needed and the front teeth react to the shaft as permanent pressure body. Consequently, it is of benefit if the shaft provides as little attack surface as possible to the teeth. The aim is, therefore, to minimize the shaft of the sucking device in width and height.

On the other hand, the shaft cannot be designed in any randomly selected width or thinness. When producing sucking devices, strict standards must be observed which are issued by the European Standards Committee in Brussels. These standards also contain specific requirements with respect to solidity of such sucking devices. The specified standard values are, therefore, established for reasons of mechanical solidity.

The shaft preferably has a width of approximately 3 to 15 mm, preferably approximately 3 to 13 mm and in particular approximately 7 to 12 mm. With shafts of this width it is generally possible to attain adequate mechanical stability or ruggedness with the currently available sucking device materials.

The shaft should be as thin as possible, as can be done from a material and production engineering aspect, taking into account, in each case, the standards for pacifiers and nutritional—and bottle sucking devices for babies and small children, to the extent they exist. The thickness of the shaft should not exceed 4 mm, if possible. Here also, a lower limit is set due to the required mechanical stability. Depending upon the utilized material, the thickness should be at least approximately 0.5 mm. A range of approximately 1 to 3 mm for thickness of the shaft is particularly preferred in actual practice. In case of a shaft with interior hollow space, the thickness preferably ranges between approximately 4 to 6 mm.

Suitable materials for the manufacture of the sucking body and/or the shaft of the inventive sucking device are vulcanized materials on the basis of natural caoutchouc latex, natural caoutchouc or synthetic polyisoprene or blends of same or also thermoplastic elastomers. These materials specifically satisfy the requirements concerning mechanical stability named in the specified standard, as well as with respect to compatibility. Needless to say, silicon can also be utilized as an alternative for manufacture of the named components.

Furthermore, it is possible to produce the shaft from plastics, such as for example polypropylene. If appropriate, a so-called high performance plastic can also be used in order to satisfy the requirements with respect to small dimensions coupled at the same time with high mechanical load factor.

In order to provide as little resistance as possible vis-a-vis the closing movements of the mouth, it has proven beneficial if the hardness degree of the material for the sucking device and the shaft lies below 50 Shore A, in particular between 30 and 45 Shore A, whereby a range between 35 and 45 Shore A is the most preferred. These hardness values can be obtained, for example, by utilization of rubber or elastomers as materials for sucking body and shaft.

BRIEF DESCRIPTION OF THE DRAWINGS

In the following, a description of the invention is given, making use of exemplary embodiments under reference to the attached drawing, in which.

DETAILED DESCRIPTION OF THE INVENTION

Figure 1:
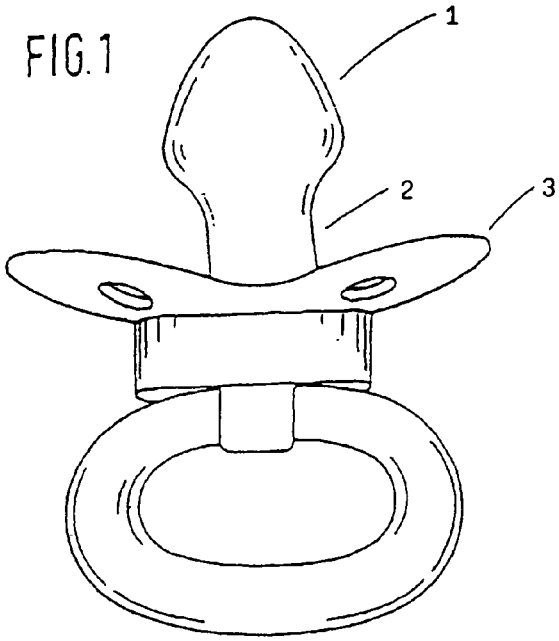
FIG. 1 depicts a bird's eye view of an inventive sucking device, which is designed as a pacifier.
Figure 2:
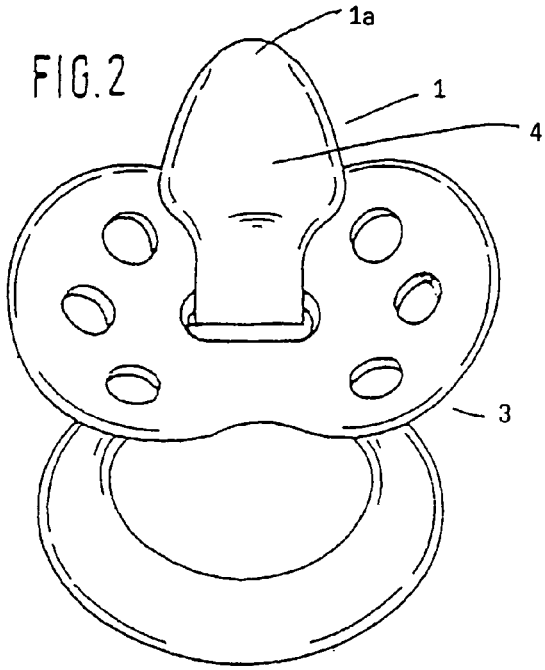
FIG. 2 depicts a view of the pacifier from below.
Figure 3:
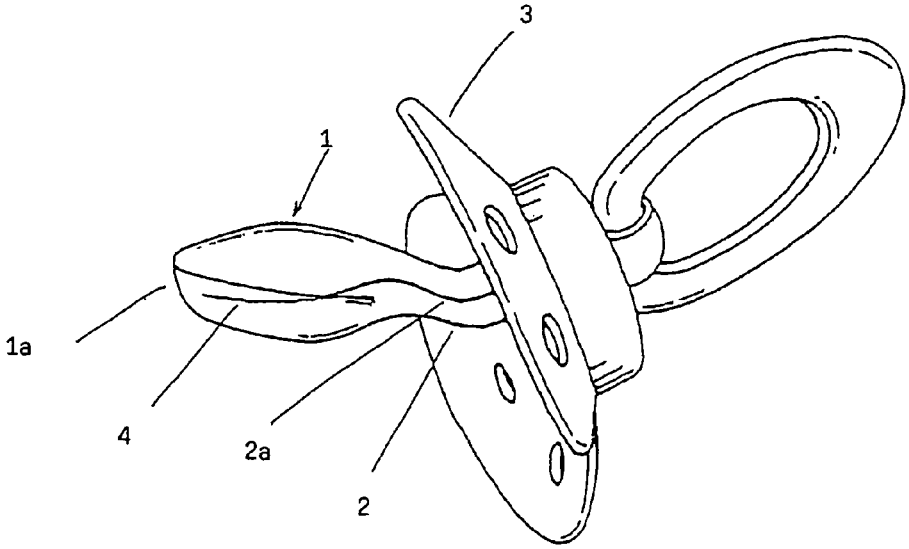
FIG. 3 depicts a perspective view of the sucking device of FIG. 1.

As represented in FIGS. 1 to 3, the inventive sucking device presents a sucking body 1, a shaft 2, adjacent to the rearward end of the sucking body, as well as a lip shield 3, connected directly or indirectly with the shaft 2. In the perspective view of FIGS. 1 and 2 it can be recognized that the sucking body 1, starting from its rearward end, conically tapers towards its anterior free end 1*a*.

This results in a certain streamlined shape of sucking body 1 in the direction of the sucking movement in the oral cavity.

On that side of the sucking body which is oriented in downward direction when in use, there is an elongated recess 4, which essentially extends, in the depicted specific embodiment, over the entire length of sucking body 1. The shape of the recess 4 can best be seen in the perspective view of FIG. 3. With correct insertion into the mouth, the sucking device must be introduced in such manner that the recess 4 is oriented in downward direction, i.e. against the tongue (caudalward), thus in the position which is represented in FIG. 3.

As can clearly be noted from FIGS. 2 and 3, the sucking body 1 has no bulge or similar (shape) at its anterior end. Instead, the recess towards the anterior end of the sucking device ends flatly, so that the recess is designed similarly to the design of a shovel. The tongue of the baby or small child can thus move, without resistance, along the sucking body.

The shaft 2 is here equipped with an angulated shape designed as a bend 2*a*, with the effect that the sucking body 1 is located above the exit location of the shaft 2 from the lip shield 3. The shaft is thus appropriately pre-shaped, so that the sucking body is already oriented toward the palate, without the need of generating additional pressure by tongue or teeth. In accordance with an alternative specific embodiment, it is, however, also possible for the shaft to have a straight design.

Figure 4:
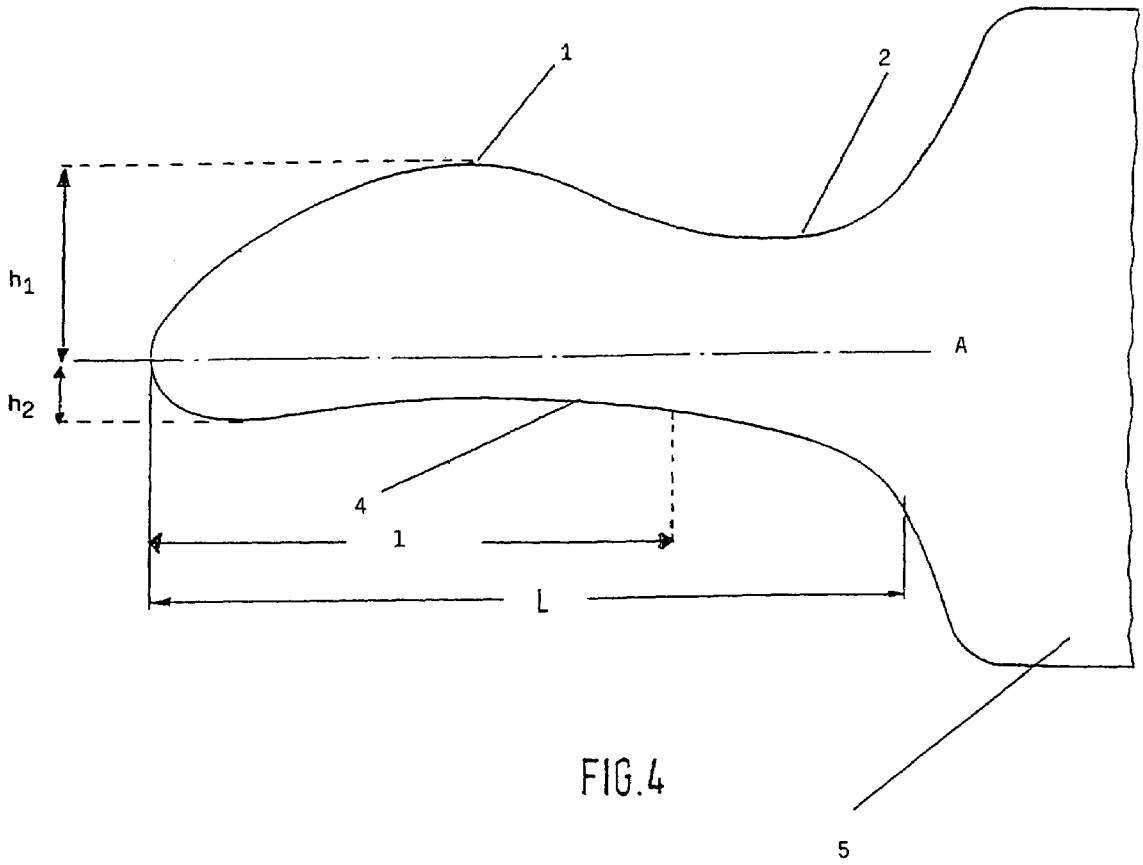
FIG. 4 depicts another specific embodiment of an inventive sucking device which is designed as nutritional- and/or bottle sucking device.

FIG. 4 depicts, in longitudinal section, another specific embodiment of an inventive sucking device, which is designed as nutritional or bottle sucking device. The nutritional sucking device likewise has a sucking body 1, adjacent to which is a shaft 2. In contrast to the specific embodiment described above with reference to FIGS. 1 to 3, the nutritional sucking device does not have a lip shield. Instead, as is generally the case with respect to nutritional sucking devices, shaft 2 passes over in its posterior region into a hollow body 5, which may be designed as one single piece with shaft 2.

The length L indicated in the Figure comprises the length of sucking body 1 and shaft 2. The transition from shaft to hollow body 5 is located at the point where the child's lips rest against the mouth-inserted sucking device. At its end, opposite the shaft, the hollow body 5 is connectable with a screw ring or pressure cap (not shown), by means of which the sucking device is connected to a drinking vessel, such as a drinking bottle. According to another specific embodiment, the sucking device is connected with the drinking vessel via the hollow body. If the sucking device is designed as nutritional sucking device, shaft 2 and sucking body 1 present an interior hollow space which is in communication with the interior of the hollow body and thus with the interior of the drinking bottle.

The sucking body 1 of the nutritional sucking device is likewise equipped with a recess 4, extending in longitudinal direction, which ends flatly toward the anterior end of the sucking body or, in the depicted specific embodiment, with only a minor curvature.

In accordance with another specific embodiment of the invention, the recess 4 may also be eliminated, so that the underside of the sucking body extends essentially flat in longitudinal direction of the sucking device. In such configuration, the ratio of height h of sucking body 1 to its length 1 preferably amounts to maximally approximately 0.6. As can be noted from the Figure, height h is composed of the height $h_1$ of the highest point above the longitudinal axis and height $h_2$ of the lowest point of the sucking body below the longitudinal axis.

The invention claimed is:

1. A sucking device comprising:

a shaft;

a sucking body integrally formed with said shaft, said sucking body including a posterior region proximal to said shaft and an anterior end distal to said shaft;

said sucking body conically tapers from said posterior region to said anterior end; and, said sucking body including a curved lower side forming a longitudinal recess extending over the entire length thereof, the curvature of said lower side decreasing from said posterior region to said anterior end.

2. The sucking device of claims 1, wherein said recess ending substantially flatly at said anterior end thereby allowing the tongue to move freely along said lower side from said anterior end to said posterior region.

3. The sucking device of claims 1, wherein said recess ending with a slight curvature at said anterior end thereby allowing the tongue to move freely along said lower side from said anterior end to said posterior region.

4. The sucking device of claim 1, wherein said sucking body comprises a hardness less than 50 Shore A.

5. The sucking device of claim 1, wherein said shaft comprises a hardness less than 50 Shore A.

6. The sucking device of claim 1, wherein said shaft is angulated including a first substantially horizontal portion, a second more vertically oriented portion, and a third substantially horizontal portion.

7. The sucking device of claim 6, wherein said shaft is rectangular in cross section.

8. The sucking device of claim 1, wherein said shaft including a length and said sucking body including a length; and, said shaft length less than said sucking body length.

9. The sucking device of claim 1, wherein said shaft including a width and said posterior region including a width; and, said shaft width less than said posterior region width.

10. The sucking device of claim 1, wherein said shaft is rectangular in cross section.

11. The sucking device of claim 1, wherein said sucking body includes a height and a length wherein a ratio of said height to said length is less than 0.7.

12. The sucking device of claim 1, wherein said recess is in the shape of a shovel having a substantially flat anterior end.

13. The sucking device of claim 1, wherein said shaft including a cross section and said posterior region including a cross section; and, said shaft cross section less than said posterior region cross section.

14. The sucking device of claim 1, wherein said shaft further includes a width and a thickness, said width is greater than said thickness.

15. A sucking device comprising:

an angulated shaft in the form a bend having a rectangular cross section including a first substantially horizontal portion, a second more vertically oriented portion, and a third substantially horizontal portion;

a sucking body integrally formed with said shaft, said sucking body including a posterior region and an anterior end;

said shaft including a length and said sucking body including a length, said shaft length less than said sucking body length; and, said sucking body conically tapers from said posterior region to said anterior end.

16. The sucking device of claim 15, wherein said sucking body includes a longitudinal recess extending along substantially the entire length thereof.

17. The sucking device of claim 15, wherein said shaft including a width and a thickness, said width is greater than said thickness and said shaft extends horizontally between the lips and the upper and lower jaws when the sucking device is correctly oriented in an oral cavity.

18. The sucking device of claim 15, wherein said sucking body comprises a hardness less than 50 Shore A.

19. The sucking device of claim 15, wherein said shaft comprises a hardness less than 50 Shore A.

20. The sucking device of claim 15, wherein said sucking body is generally located above said first horizontal portion of said shaft.

21. A sucking device comprising:

an angulated shaft in the form a bend having a rectangular cross section including a first substantially horizontal portion, a second more vertically oriented portion, and a third substantially horizontal portion;

a sucking body integrally formed with said shaft, said sucking body including a posterior region and an anterior end; and, said sucking body including a curved lower side forming a longitudinal recess extending from said posterior region to said anterior end.

22. The sucking device of claim 21, wherein said recess includes a convex curvature continuously decreasing in indentation from said posterior region to said anterior end.

23. The sucking device of claim 21, wherein said recess is in the shape of a shovel having a substantially flat anterior end.

24. A sucking device comprising:

a sucking body;

a shaft connected to said sucking body, said shaft comprises an angulated shape in the form of a bend having a lower portion and an upper portion wherein said sucking body is generally located above said lower portion of said shaft;

said shaft including a width and a thickness, wherein said width is greater than said thickness, and said shaft extends horizontally between the lips and the upper and lower jaws when the sucking device is correctly oriented in an oral cavity; and, said shaft including a length and said sucking body including a length, said shalt length less than said sucking body length.

25. The sucking device as set forth in claim 24, wherein said sucking body includes a curved lower side forming a recess extending the entire length of said sucking body and oriented toward the tongue in an oral cavity.

26. The sucking device as set forth in claim 25, wherein said sucking body includes a posterior region and an anterior end, said sucking body conically tapers from said posterior region to said anterior end.

27. The sucking device as set forth in claim 26, wherein the curvature of said lower side decreases from said posterior region to said anterior end.

28. The sucking device as set forth in claim 27, wherein said recess ends essentially flat towards said anterior end of said sucking body.

29. The sucking device as set forth in claim 24, wherein said shaft further including a first substantially horizontal portion, a second more vertically oriented portion, and a third substantially horizontal portion.

* * * * *